US009673551B2

(12) United States Patent
Chu et al.

(10) Patent No.: US 9,673,551 B2
(45) Date of Patent: Jun. 6, 2017

(54) ELECTRICAL CONNECTOR WITH ONE-PIECE TERMINALS

(71) Applicant: Advanced-Connectek Inc., New Taipei (TW)

(72) Inventors: Ping-Chuan Chu, New Taipei (TW); Xiao-Juan Qi, New Taipei (TW); Shu-Lin Duan, New Taipei (TW); Ching-Tien Chen, New Taipei (TW); Wei Wan, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 11 days.

(21) Appl. No.: 14/597,348

(22) Filed: Jan. 15, 2015

(65) Prior Publication Data

US 2015/0229057 A1 Aug. 13, 2015

(30) Foreign Application Priority Data

Feb. 10, 2014 (CN) ..... 2014 1 0046155

(51) Int. Cl.
*H01R 13/24* (2006.01)
*H01R 12/57* (2011.01)
*H01R 13/432* (2006.01)

(52) U.S. Cl.
CPC ..... *H01R 13/2428* (2013.01); *H01R 13/2464* (2013.01); *H01R 12/57* (2013.01); *H01R 13/432* (2013.01)

(58) Field of Classification Search
CPC ..... H01R 13/2428; H01R 12/714; H01R 13/2421; H01R 13/2464; H01R 12/707; H01R 12/716; H01R 43/16; H01R 12/52; H01R 12/712; H01R 13/20; H01R 13/22; H01R 13/24; H01R 13/432; H01R 13/506
USPC ..... 439/862, 700
See application file for complete search history.

(56) References Cited

U.S. PATENT DOCUMENTS 7,527,532 B2 * 5/2009 Northey ..... H01R 13/2428 439/700
7,785,150 B1 * 8/2010 Ho ..... H01R 12/57 439/627
7,803,011 B1 * 9/2010 Mai ..... H01R 13/2428 439/500
8,079,875 B2 * 12/2011 Ho ..... H01R 13/2428 439/627
8,353,730 B1 * 1/2013 Wang ..... H01R 13/2421 439/515

(Continued)

FOREIGN PATENT DOCUMENTS

TW M346937 U 12/2008
TW M418465 U 12/2011

(Continued)

*Primary Examiner* — James Harvey
*Assistant Examiner* — Matthew T Dzierzynski

(57) ABSTRACT

An electrical connector has an insulative body and multiple terminals. The insulative body has multiple mounting holes and multiple guiding channels. The terminals are mounted respectively in the mounting holes and each terminal has an electrical contacting portion mounted slidably in one of the guiding channels. The guiding channels guide and ensure a corresponding electrical contacting portion to move linearly without being inadvertently jammed or irrecoverably deformed. Therefore, the life-span of the electrical connector is increased.

11 Claims, 7 Drawing Sheets

(56) References Cited

U.S. PATENT DOCUMENTS

| | | | | |
|---|---|---|---|---|
| 8,657,635 | B2 * | 2/2014 | Koyama | H01R 13/2464 439/500 |
| 8,974,246 | B2 * | 3/2015 | Son | H01R 4/4809 439/500 |
| 2001/0012734 | A1 * | 8/2001 | Nishimatsu | H01R 13/2428 439/700 |
| 2011/0034074 | A1 * | 2/2011 | Mai | H01R 13/6594 439/607.01 |

FOREIGN PATENT DOCUMENTS

| | | | |
|---|---|---|---|
| TW | 201332225 | A | 8/2013 |
| TW | M462453 | U | 9/2013 |

* cited by examiner

ELECTRICAL CONNECTOR WITH ONE-PIECE TERMINALS

BACKGROUND OF THE INVENTION

1. Field of the Invention

The present invention relates to a connector, and more particularly to an electrical connector that has multiple one-piece terminals. Each one-piece terminal has excellent resilience to provide stable extension and retraction functions. Furthermore, the one-piece terminal is capable of linearly extending or retracting instead of extending or retracting along a non-linearly and irregularly path, which prevents the one-piece terminal from being deformed or damaged.

2. Description of Related Art

Electrical connectors are commonly used electrical components in electronic devices and allow the electronic device to connect to another one to implement signal transmission or power supply between the connected electronic devices.

A conventional portable electronic device such as a smart phone usually has a battery chamber and a spring-type battery connector. The spring-type battery connector, as disclosed in the TW patent publication No. 201332225, TW patent No. M418465 or TW patent No. M462453, is mounted in the battery chamber and has an insulative body and multiple terminal assemblies mounted in the insulative body. Each terminal assembly has a soldering terminal, a contacting terminal and a spring. The contacting terminal is bullet-like and able to contact a pad contact of a battery. The spring is mounted between the soldering terminal and the contacting terminal and presses against the contacting terminal to extend out of the insulative body. However, the terminal assembly with multiple components is complicated in structure and fabrication. Inadvertent dislocation between adjacent components easily occurs and causes the contacting terminal to be jammed and not able to extend or retract. Furthermore, when large current are transmitted through the terminal assemblies, the terminal assemblies are overheated and the battery connector fails due to an insufficient contacting area between adjacent two of the soldering terminal, the spring and the contacting terminal.

With reference to FIG. 7, TW utility model patent No. M346937 discloses a connector with one-piece terminals. The connector has an insulative body 70, a shell 80 and multiple terminals 90. The shell 80 covers the insulative body 70. The insulative body 70 has multiple mounting holes 71 defined therein. The terminals 90 are formed into one piece and are mounted respectively in the mounting holes 71 of the insulative body 70. Each terminal 90 has a soldering portion 91, a spring portion 92 and a contacting portion 93. The spring portion 92 is horizontally zigzag, is formed on and protrudes from the soldering portion 91, and has a connecting section 921 and two resilient sections 922. The connecting section 921 is parallel to an axial direction of the terminal 90. The resilient sections 922 are connected respectively to two opposite ends of the connecting section 921 and are resiliently foldable relative to the connecting section 921. The contacting section 93 is V-shaped and formed on one of the resilient sections 922. However, when the spring portion 92 of the terminal 90 is compressed, the resilient sections 922 pivots relative to the connecting section 921 such that the contacting portion 93 simultaneously retracts and sways left and right relative to the axial direction of the terminal 90. Therefore, the contacting portion 93 is retracted along a curvedly or obliquely non-linear path and is easily jammed in the mounting hole 71. Furthermore, the V-shaped contacting portion 93 contacts an inner surface of the mounting hole 71 by point-contact instead of area-contact such that the inner surface of the mounting hole 71 cannot guide or assist the contacting portion 93 to move along a linear path, which further increases a probability of the contacting portion 93 obliquely deformed and jammed in the mounting hole 71. The deformed or jammed contacting portion 93 of the terminal 90 cannot stably contact the pad contact of the battery and therefore causes the defects or failure of power or signal transmission between the battery and the electronic device in which the connector is incorporated. Furthermore, the connecting section 921 is a straight section being parallel to an axial direction of the terminal 90 and cannot be compressed, which disadvantages the compressing performance of the terminal 90.

To overcome the shortcomings, the present invention provides an electrical connector with one-piece terminals to mitigate or obviate the aforementioned problems.

SUMMARY OF THE INVENTION

The main objective of the invention is to provide an electrical connector that has multiple one-piece terminals. Each one-piece terminal has excellent resilience to provide stable extension and retraction functions. Furthermore, the one-piece terminal is capable of linearly extending or retracting instead of extending or retracting along a non-linearly and irregularly path, which prevents the one-piece terminal from being deformed or damaged.

An electrical connector in accordance with the present invention comprises an insulative body and multiple terminals. The insulative body has multiple mounting holes and multiple guiding channels. The terminals are mounted respectively the mounting holes and each terminal has an electrically contacting portion mounted slidingly in one of the guiding channels. The guiding channels guides and ensures a corresponding electrically contacting portion to move linearly without being inadvertently jammed or irrecoverably deformed. Therefore, the life-span of the electrical connector is increased.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
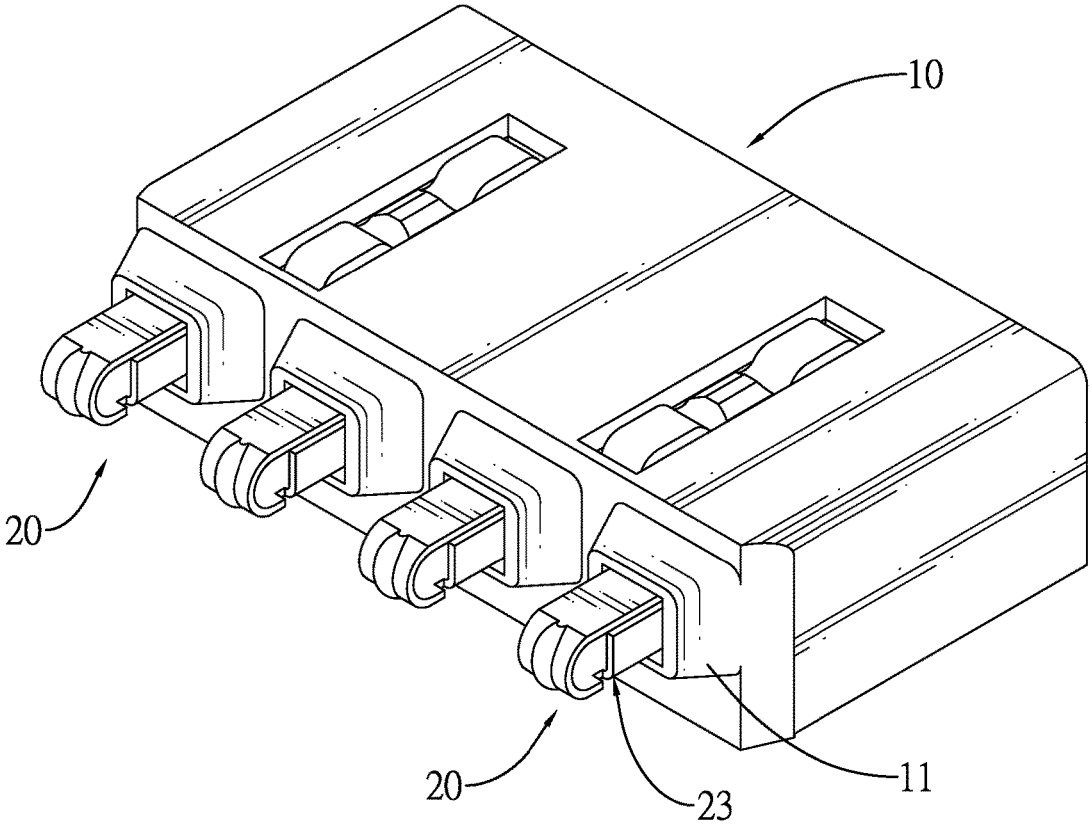
FIG. 1 is a perspective view of an electrical connector with one-piece terminals in accordance with the present invention.

With reference to FIG. 1, an electrical connector in accordance with the present invention comprises an insulative body 10 and multiple terminals 20.

Figure 2:
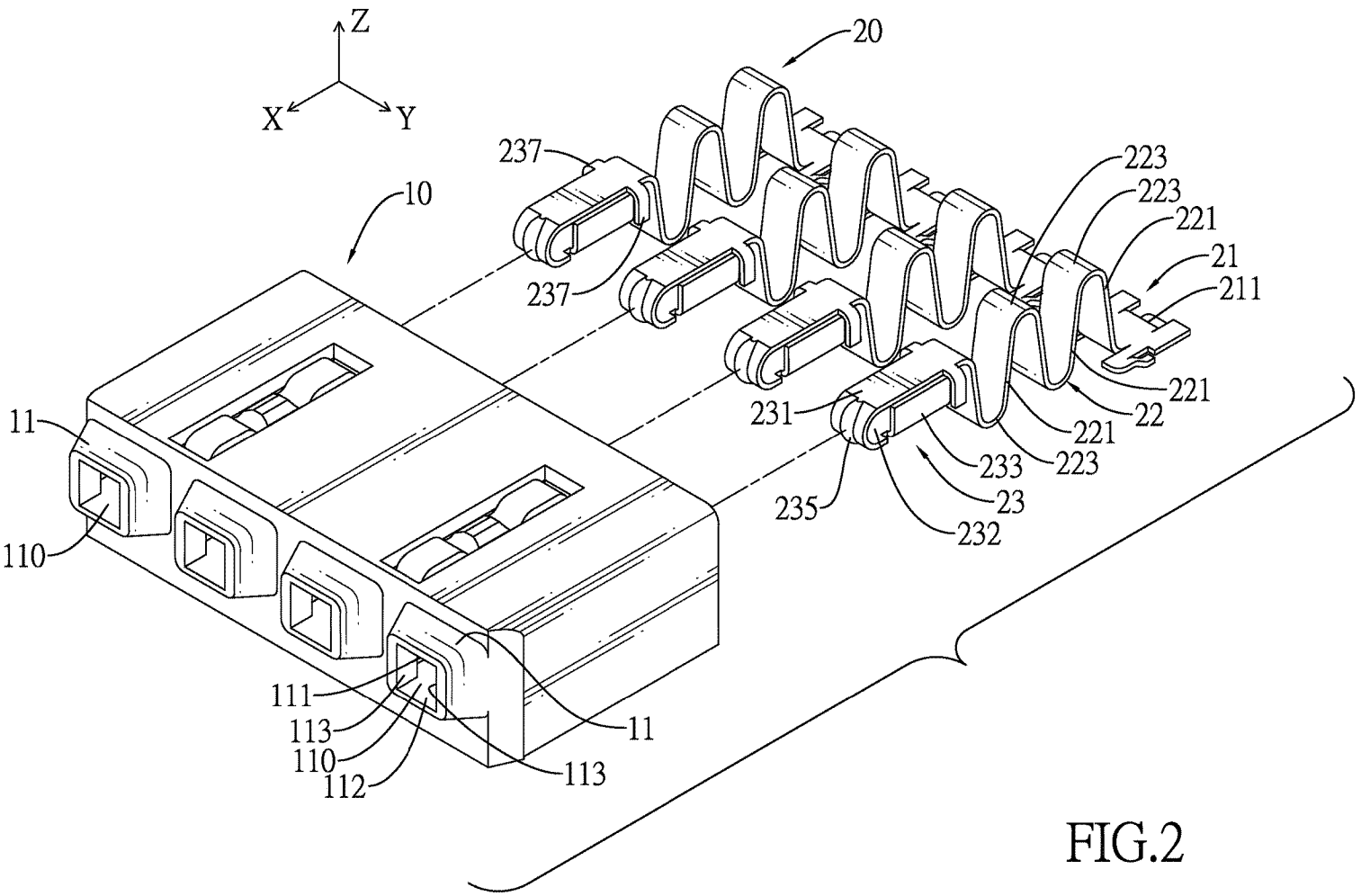
FIG. 2 is a front exploded perspective view of the electrical connector in FIG. 1.
Figure 3:
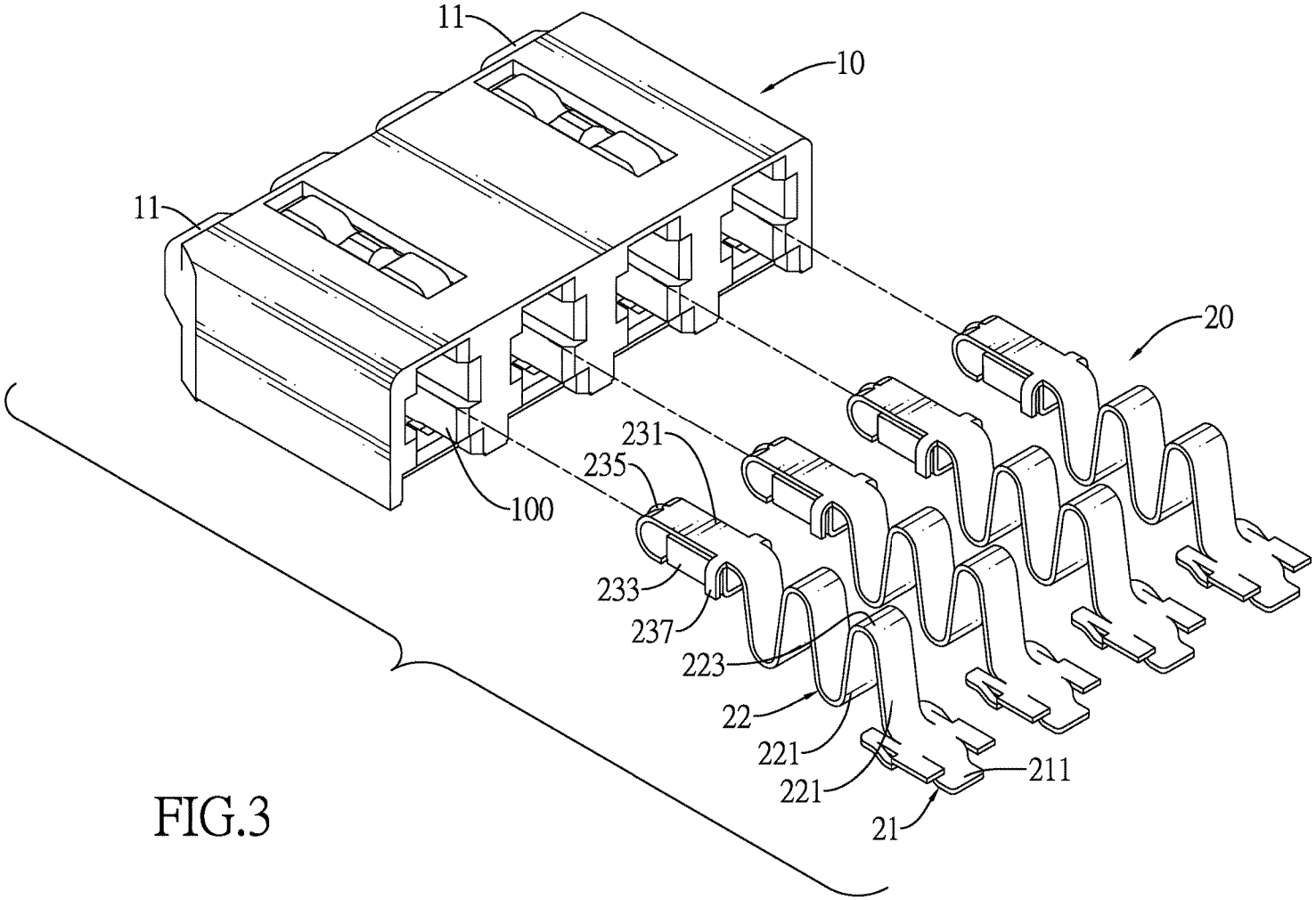
FIG. 3 is a rear exploded perspective view of the electrical connector in FIG. 1.

With further reference to FIGS. 2 and 3, the insulative body 10 has multiple mounting holes 100 and multiple guiding members 11. The mounting holes 100 are defined in the insulative body 10. The guiding members 11 are formed on a front end of the insulative body 10 and correspond to the mounting holes 100. Each guiding member 11 has a guiding channel 110. The guiding channel 110 is rectangular, is defined in the guiding member 11, communicates with a corresponding mounting hole 100 and has an inner surface. The inner surface may have an inner top surface 111, an inner bottom surface 112 and two opposite inner side surfaces 113 formed between the inner top surface 111 and the inner bottom surface 112. A cross-sectional area of the guiding channel 110 is smaller than a cross-sectional area of the mounting holes 100.

Figure 4:
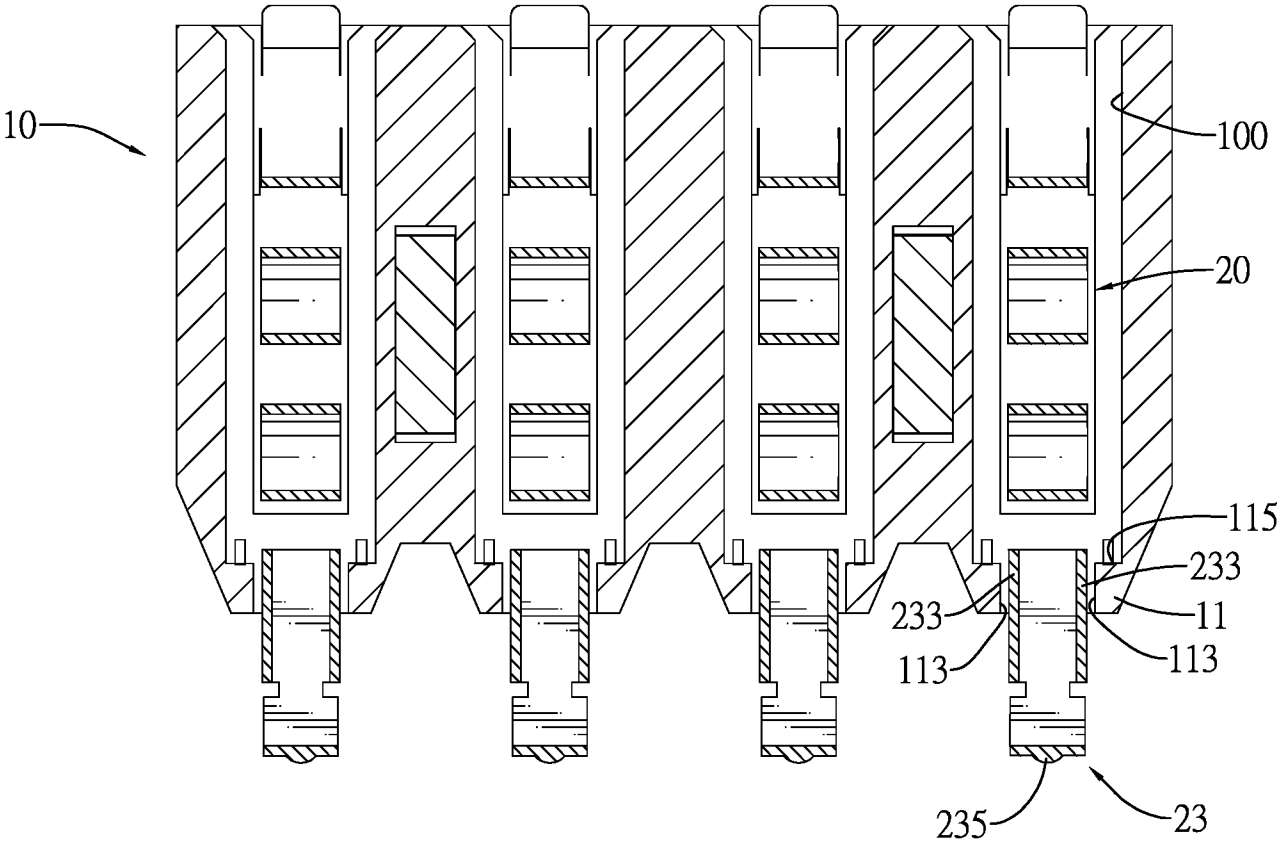
FIG. 4 is a cross sectional top view of the electrical connector in FIG. 1.
Figure 5:
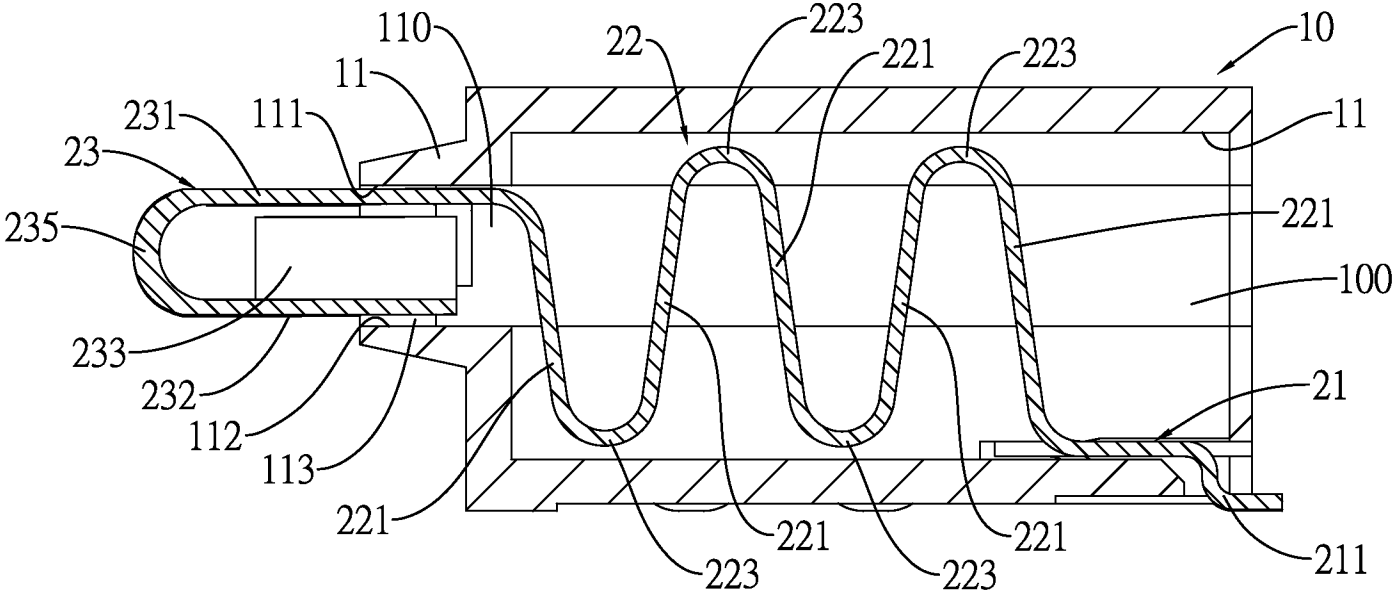
FIG. 5 is a cross sectional side view of the electrical connector in FIG. 1.
Figure 6:
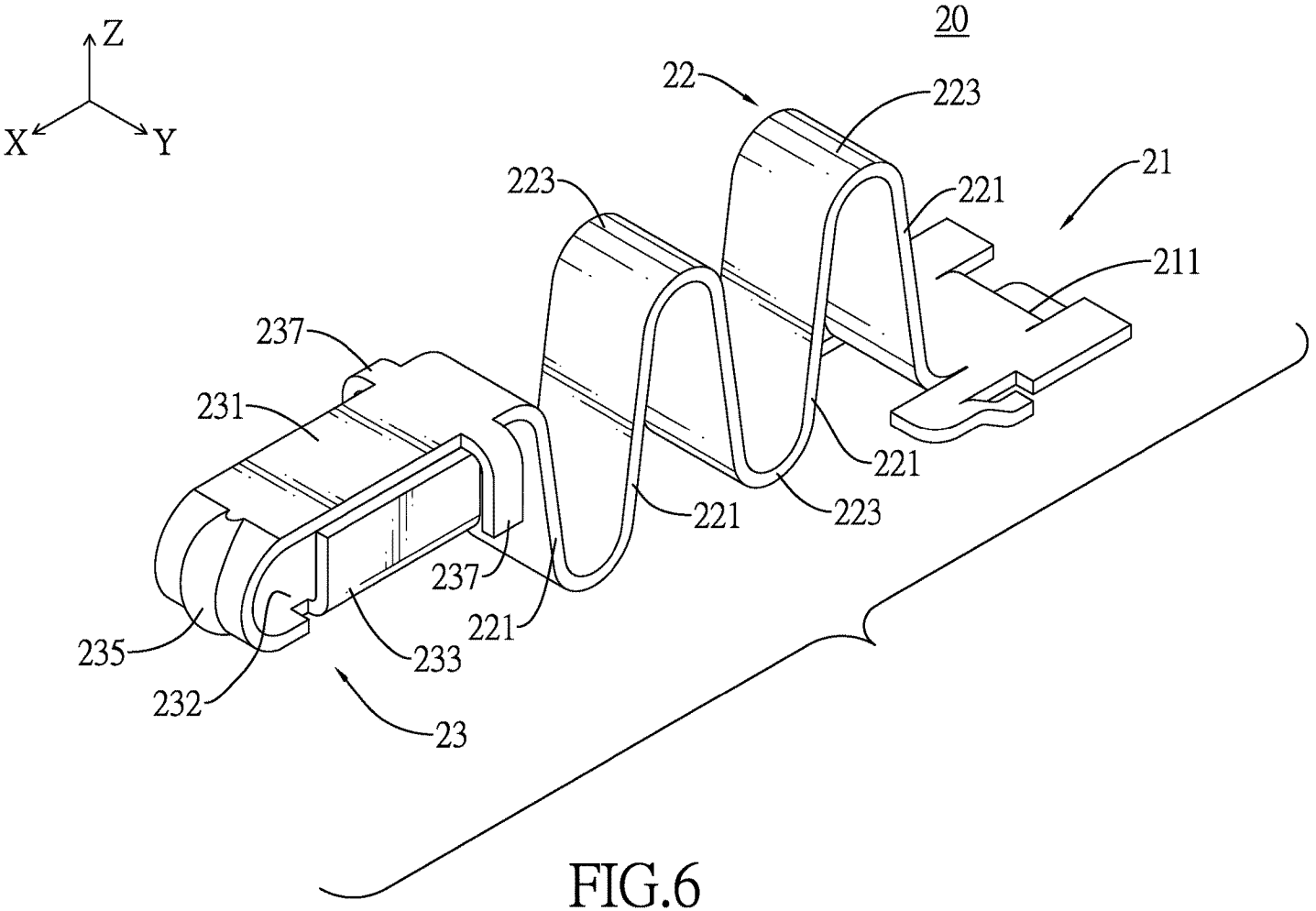
FIG. 6 is an enlarged perspective view of a terminal of the electrical connector in FIG. 1.
Figure 7:
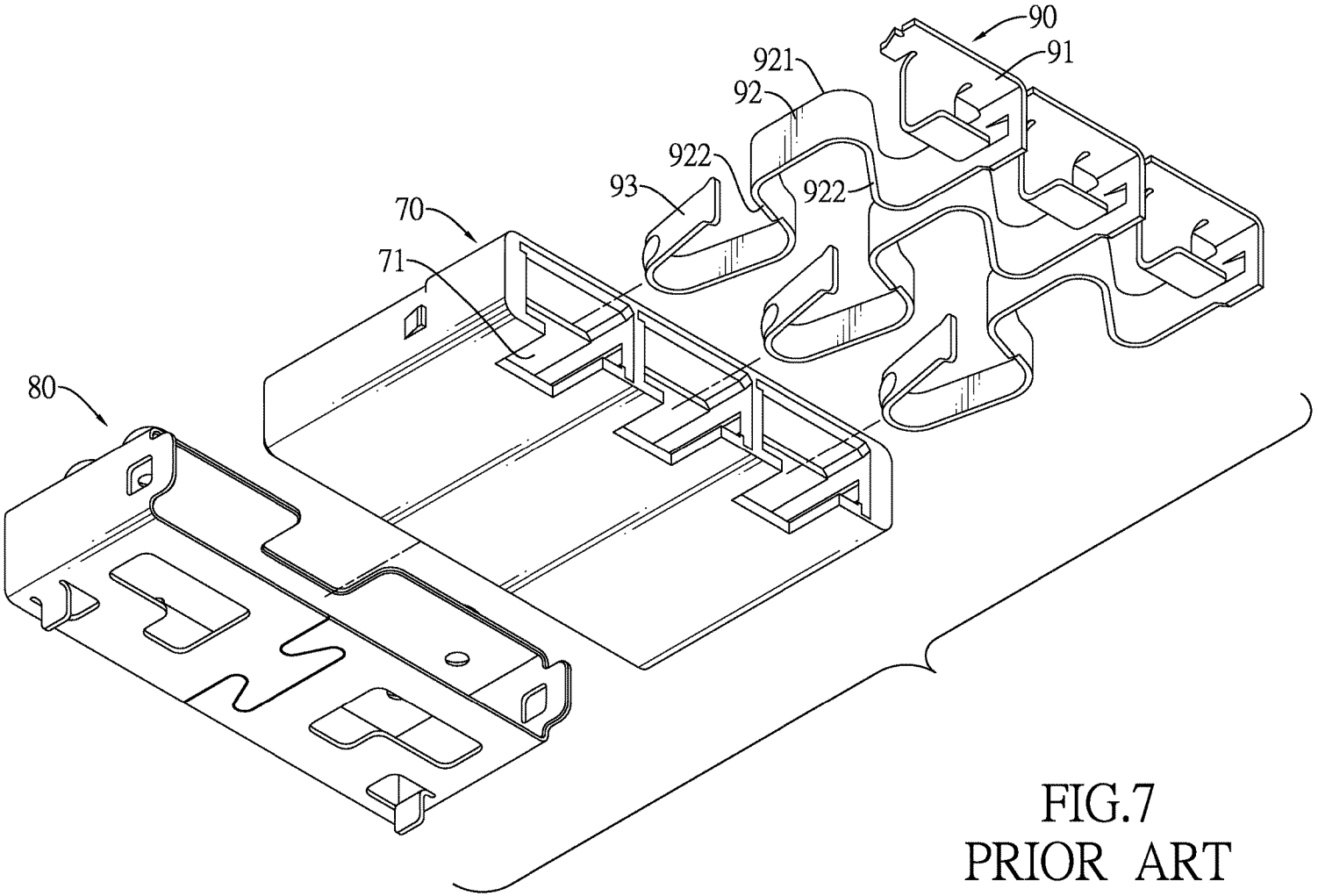
FIG.7 PRIOR ART
FIG. 7 is an exploded perspective view of a conventional connector with terminals in accordance with prior art.

With further reference to FIGS. 4 and 5, each terminal 20 is one-piece and has a soldering portion 21, a resilient portion 22 and an electrical contacting portion 23. The resilient portion 22 of each terminals 20 is received in the corresponding mounting hole 100 of the insulative body 10, and the electrical contacting portion 23 of each terminal 20 is received in the corresponding guiding channel 110 of the guiding members 11. Each mounting hole 100 has a cross-sectional shape that allows the corresponding resilient portion 22 to be fitted therein for longitudinal movement along a longitudinal direction of the terminal 20. Each guiding channel 110 has a cross-sectional shape that allows the corresponding electrical contacting portion 23 to be fitted therein for longitudinal movement along a longitudinal direction of the terminal 20. In other words, the guiding channel 110 just allows the corresponding electrical contacting portion 23 to be received slidingly therein and could not allow the resilient portion 22 to be received slidingly therein because the cross-sectional area of the electrical contacting portion 23 is smaller than the resilient portion 22.

The resilient portion 22 is compressible and vertically wave-like, is formed on and protrudes forward from the soldering portion 21, is received in a corresponding mounting hole 100, and is constructed by multiple V-shaped portions connected in series to show a serpentine shape. The resilient portion 22 has multiple resilient arms 221 and multiple connecting portions 223. The connecting portion 223 are curved and deformable, and are alternately formed between and connected to resilient arms 221 such that two adjacent resilient arms 221 and one connecting portion 223 form one V-shaped portion. Preferably, the resilient portion 22 zigzags along a plane constituted by a horizontal axis X and a vertical axis Z, as shown in FIG. 2.

The soldering portion 21 is extended from one end of the resilient portion 22. In other words, the soldering portion 21 extends from one end of the resilient arm 221 of the resilient portion 22. The soldering portion 21 has a soldering plate 211. The soldering plate 211 extends from the soldering portion 21 and is folded downwardly out of a bottom surface of the insulative body 10. The folded soldering plate 211 has a larger surface area in comparison to a conventional one to allow sufficient solder to adhere thereto such that the soldering performance is increased.

The electrical contacting portion 23 is formed on and protrudes forward from the resilient portion 22, is received slidingly in a corresponding guiding channel 110 of the guiding member 11 and contacts the inner surface of the corresponding guiding channel 110 by area-contact. The electrical contacting portion 23 may be rectangular and have a top surface 231, a bottom surface 232, two opposite side surfaces 233, two opposite blocking portions 237 and a convex contacting rib 235. The top surface 231 contacts the inner top surface 111 of the corresponding guiding channel 110. The bottom surface 232 contacts the inner bottom surface 112 of the corresponding guiding channel 110. The side surfaces are formed between the top surface 231 and the bottom surface 232 and respectively contact the inner side surfaces 113 of the corresponding guiding channel 110. The blocking portions 237 may be L-shaped and extend downwardly from two sides of the end of the top surface 231 of the electrical contacting portion 23. The blocking portions 237 abut against an inner wall 115 of a peripheral portion of the guiding member 11 to prevent the electrically contacting portion 23 from sliding out of the guiding channel 110.

The convex contacting rib 235 is cat-pupil-like and is formed centrally on a front end of the electrical contacting portion 23 to improve electrically contacting performance. In other words, the convex contacting rib 235 is a convexity formed centrally on a front surface of the electrical contacting portion 23 to improve electrically contacting performance.

When each terminal 20 is retracted or extends, the electrical contacting portion 23 is guided by the corresponding guiding channel 110 and moves linearly along an axial direction of the terminal 20 that is parallel to the horizontal axis X.

The electrical connector has the following advantages.

1. Each terminal 20 is formed in one-piece to avoid problems of complicated structures and fabrication. Furthermore, the terminal 20 is formed integrally without multiple components to avoid problems of insufficient contacting areas between adjacent components. The integrally formed terminal 20 allows large current to pass through.

2. The electrical contacting portion 23 of each terminal 20 contacts the inner surface of the corresponding guiding channel 110 by area-contact instead of point contact such that the guiding channel 110 effectively guides the electrical contacting portion 23 to move linearly and prevents the electrical contacting portion 23 from being inadvertently jammed or irrecoverably deformed. Therefore, the terminals 20 may repetitively normally be retracted or extended to stably contact pad contacts of a battery mounted into the electrical connector, which improves the life span of the electrical connector.

3. Each terminal 20 has multiple V-shaped portions connected in series and each allows each V-shaped portion may be compressed for a stroke such that a total compression stroke of the V-shaped portions of each terminal is larger than that of a conventional terminal and provides higher resilient force to ensures stable electrical contact between the terminal 20 and the pad contact of the battery.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An electrical connector comprising:

an insulative body having:

multiple mounting holes defined in the insulative body; and multiple guiding members formed on a front end of the insulative body and corresponding respectively to the mounting holes, and each guiding member having a guiding channel defined in the guiding member, communicating with a corresponding mounting hole, wherein a cross-sectional area of each guiding channel is smaller than a cross-sectional area of each mounting hole, and each guiding member is protruding from an outer surface of a front wall of the insulative body; and multiple terminals received respectively in the mounting holes of the insulative body, received respectively in the guiding channels of the guiding members, and each terminal being one-piece and comprising:

a soldering portion;

a resilient portion being compressible and vertically wave-like, formed on and protruding forward from the soldering portion and received in a corresponding mounting hole; and an electrical contacting portion formed on and protruding forward from the resilient portion, and received slidably in a corresponding guiding channel of the guiding member;

wherein each electrical contacting portion comprises a top surface, a bottom surface, two opposite side surfaces, two opposite blocking portions and a convex contacting rib, wherein the top surface and the bottom surface are separated by a gap, and the opposite side surfaces and the convex contacting rib are formed between the top and bottom surfaces;

wherein the two blocking portions respectively extend downwardly from two sides of an end of the top surface of the electrical contacting portion, the blocking portions abut against an inner wall of a peripheral portion of a corresponding guiding member to prevent the electrical contacting portion from sliding out of the corresponding guiding channel, and the convex contacting rib is a convexity formed centrally on a front surface of the electrical contacting portion;

wherein the top surface contacts an inner top surface of the corresponding guiding channel, the bottom surface contacts an inner bottom surface of the corresponding guiding channel, the side surfaces respectively contact inner side surfaces of the corresponding guiding channel; and wherein when each terminal retracts or extends, the electrical contacting portion is guided by the corresponding guiding channel and moves linearly along an axial direction of the terminal.

2. The electrical connector as claimed in claim 1, wherein the resilient portion of each terminal is constructed by multiple V-shaped portions connected in series and comprises multiple resilient arms; and multiple connecting portions alternately formed between and connected to the multiple resilient arms such that two adjacent resilient arms and one connecting portion form one V-shaped portion.

3. The electrical connector as claimed in claim 2, wherein each connecting portion is curved and deformable.

4. The electrical connector as claimed in claim 3, wherein the resilient portion of each terminal zigzags along a plane constituted by a horizontal axis and a vertical axis.

5. The electrical connector as claimed in claim 1, wherein each blocking portion is L-shaped.

6. The electrical connector as claimed in claim 1, wherein the soldering portion of each terminal has a soldering plate folded, wherein the soldering portion extends from one end of the resilient arm of the resilient portion and the soldering plate extends from the soldering portion and is folded downwardly out of a bottom surface of the insulative body.

7. The electrical connector as claimed in claim 1, wherein each mounting hole has a cross-sectional shape that allows the corresponding resilient portion to be fitted therein for longitudinal movement along a longitudinal direction of the terminal and each guiding channel has a cross-sectional shape that allows the corresponding electrical contacting portion to be fitted therein for longitudinal movement along the longitudinal direction of the terminal.

8. The electrical connector as claimed in claim 1, wherein a guiding length for guiding the electrical contacting portion of each terminal is a channel length of the guiding channel of the corresponding guiding member plus a thickness of the front wall of the insulative body.

9. The electrical connector as claimed in claim 1, wherein each guiding member is a tapered protrusion protruding from the outer surface of the front wall, and each guiding member has a truncated quadrangular-pyramid cross section.

10. The electrical connector as claimed in claim 1, wherein one end of each terminal is connected to the electrical contacting portion, and the other end of each terminal is connected to the soldering portion, wherein the soldering portion extends away from the terminal in a direction of a longitudinal axis of the terminal.

11. The electrical connector as claimed in claim 1, wherein the top surface of each electrical contacting portion is parallel to the inner top surface of the corresponding guiding channel, the bottom surface of each electrical contacting portion is parallel to the inner bottom surface of the corresponding guiding channel, and the side surfaces of each electrical contacting portion are respectively parallel to the inner side surfaces of the corresponding guiding channel.

* * * * *